US006189885B1

(12) United States Patent
Hamot

(10) Patent No.: US 6,189,885 B1
(45) Date of Patent: Feb. 20, 2001

(54) GAME OF THE TABLE SOCCER TYPE

(76) Inventor: Thierry Hamot, 30-32 rue de Lorraine F 75019, Paris (FR)

( * ) Notice: Under 35 U.S.C. 154(b), the term of this patent shall be extended for 0 days.

(21) Appl. No.: 09/392,776

(22) Filed: Sep. 9, 1999

(51) Int. Cl.[7] ..... A63F 7/06

(52) U.S. Cl. ..... 273/108.1; 273/108.51; 273/108.53; 273/108.56; 273/118 A; 273/126 A

(58) Field of Search ..... 273/108, 108.1, 273/108.51, 108.52, 108.53, 108.54, 108.55, 108.56, 126 R, 126 A, 460, 461, 118 A, 444, 441, 443, 442, 454, 455, 456; 446/129–139, 454, 455

(56) References Cited

U.S. PATENT DOCUMENTS

| | | | |
|---|---|---|---|
| 637,676 | * | 11/1899 | Shaw . |
| 1,876,469 | * | 9/1932 | Quinn . |
| 2,513,728 | * | 7/1950 | Koci . |
| 2,716,028 | * | 8/1955 | Yaeger . |
| 2,857,710 | * | 10/1958 | Brown . |
| 2,964,320 | * | 12/1960 | Lebrun . |
| 3,130,970 | * | 4/1964 | Hutsell . |
| 3,899,174 | | 8/1975 | Berarducci . |
| 3,976,296 | * | 8/1976 | Smith . |
| 4,007,932 | * | 2/1977 | Lebrun . |
| 5,275,401 | | 1/1994 | Llorens . |

FOREIGN PATENT DOCUMENTS

| | | | | |
|---|---|---|---|---|
| 657782 | * | 1/1965 | (CA) | 273/85 A |
| 702391 | * | 1/1965 | (CA) | 273/85 B |
| 2609458 | | 9/1977 | (DE) . | |
| 3046136 | | 7/1982 | (DE) . | |
| 2668713 | | 5/1992 | (FR) . | |
| WO 91/15279 | | 10/1991 | (WO) . | |

* cited by examiner

*Primary Examiner*—Sebastiano Passaniti
(74) *Attorney, Agent, or Firm*—Greenblum & Bernstein, P.L.C.

(57) ABSTRACT

A game, of the table soccer type, comprises a playing surface, pieces imitating players and a ball simulating a football. It has, along the table, on each of two opposite sides, a series of control levers, each lever corresponding to the movement of a player. Each player is connected to a carriage comprising two drive motors, each of which drives a wheel, and an electronic receiving unit. Each control lever is attached to a transmitter unit in order to control selectively the power supply of one or other of the motors in one direction or the other.

9 Claims, 5 Drawing Sheets

GAME OF THE TABLE SOCCER TYPE

BACKGROUND OF THE INVENTION

1. Field of the Invention

The present invention relates to a game of the table soccer type.

2. Description of the Prior Art

Various games of this type exist but do not allow the pieces simulating the players to be moved over the entire playing surface.

One of the purposes of the present invention is to produce a game in which the pieces can move over the entire playing surface in order to imitate the game as it is played on a pitch.

SUMMARY OF THE INVENTION

The game according to the invention comprises a playing surface, pieces imitating players, a ball simulating a football and, along the table, on each of two opposite sides, a series of control levers, wherein each lever corresponds to the movement of a player, each player is connected to a carriage comprising two motors, each of which drives a wheel, and an electronic receiving unit, and each control lever is attached to a transmitter unit in order to control selectively the power supply to one or other of the motors in one direction or the other.

The table can comprise two parallel tabletops, namely an upper tabletop and a lower tabletop, between which the carriages are suitably guided and comprising, on each of their upper parts, a permanent magnet, and each player has a base in which a corresponding permanent magnet is inserted. The game therefore has no visible mechanical parts.

In order than no braking effect is produced on the playing surface for the player or for the carriage, the magnets in the carriage and the player's base are fixed so that a slight gap is formed between the two faces of the corresponding upper tabletop.

The upper tabletop can have an upper surface consisting of a mat, a framework, an insulator and a conductive surface.

The lower tabletop can have a conductive upper surface, an insulator and a framework.

Each carriage preferably comprises insulating balls co-operating with the lower face of the upper tabletop and insulating balls co-operating with the upper face of the lower tabletop. In the way the carriages can move in all directions between the tabletops.

Each carriage preferably comprises sliding contacts co-operating with the conductive surface of the upper tabletop and sliding contacts cooperating with the conductive surface of the lower tabletop. This simplifies the power supply to the various circuits carried by the carriages.

Each lever can be connected to a transmitting micro-controller enabling a network controller micro-controllers messages relating to the position of the handles in order to transmit these commands to a modem which, using the carrier current technique, associates the messages with the power supply of the receiving modules of the carriages, comprising a demodulating modem upstream of a message-receiving micro-controller and in which are installed motors associated with Darlington bridges.

The levers can control two potentiometers whose voltages at the analog port define, for one of them, three zones, namely an intermediate rest zone between a forward movement zone and reverse movement zone, whilst the other one defines three zones, namely an intermediate rest zone between a zone of pivoting toward the right and a zone on pivoting toward the left, the generation of these voltages being simulated by two computers which compare the analog voltage with a high reference voltage and with a low reference voltage, the output value of these comparators being bits which determine the direction of rotation of the motors.

The invention will now be described in greater detail and by way of example only with reference to a particular embodiment shown in the accompanying drawings.

DETAILED DESCRIPTION OF THE PREFERRED EMBODIMENTS

Figure 1:
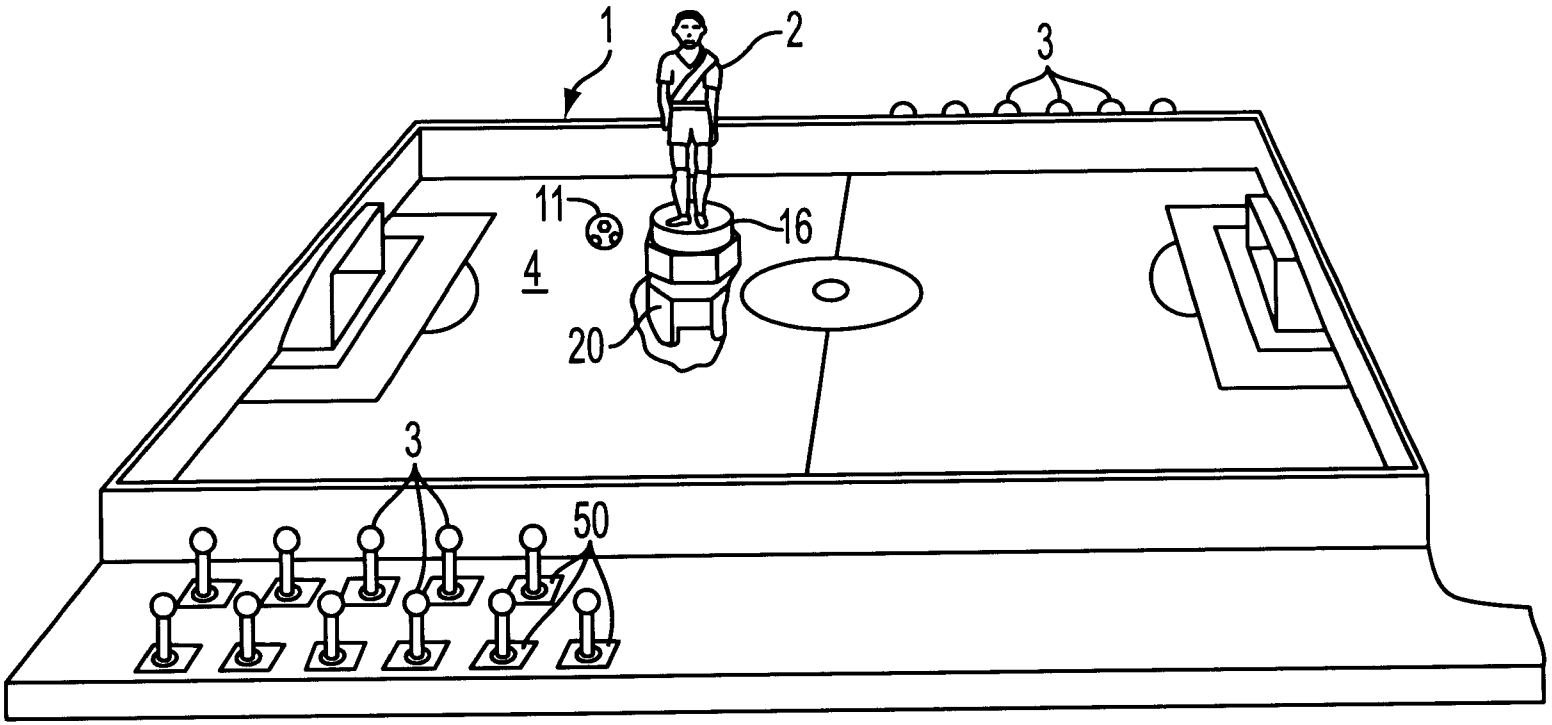
FIG. 1 is a diagrammatic perspective view of a game according to the invention.
Figure 2:
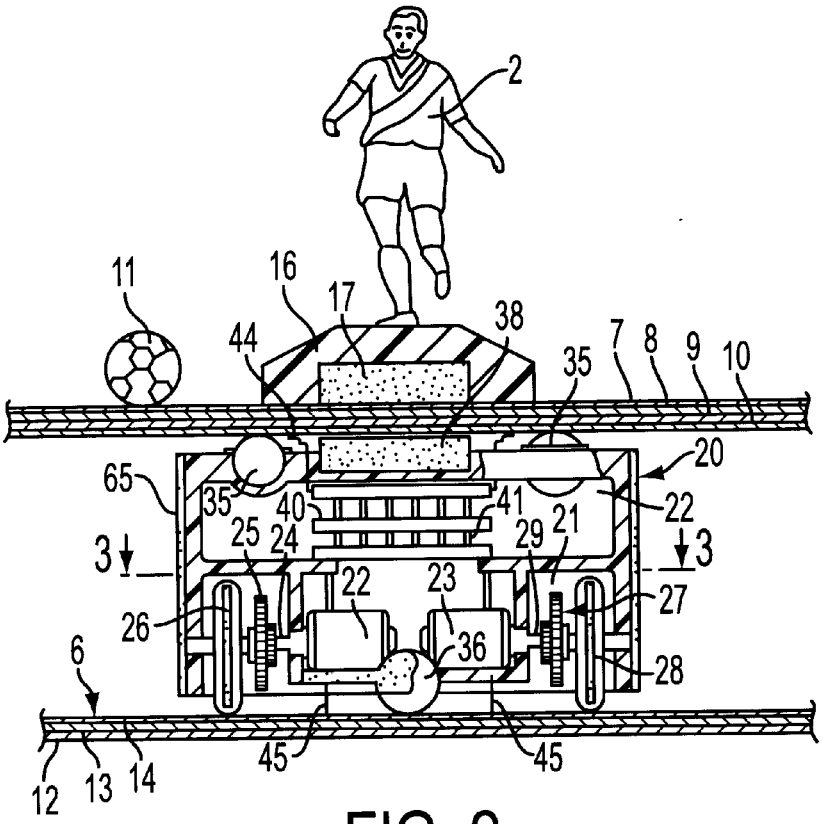
FIG. 2 is a vertical cross-sectional view of the table through the vertical axis of a carriage.
Figure 3:
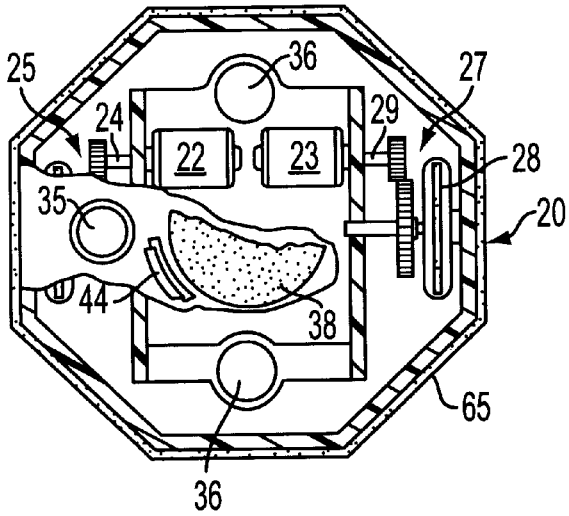
FIG. 3 is a plan view of a carriage.

The game, as shown in the figures, comprises a table 1 upon which a certain number of players 2 can move and a series of control devices 3 on each side, each control device 3 comprising a lever automatically returned to a neutral position in which that lever is not effective. In a forward tilted position, the lever commands movement of the player 2 in one direction and, when tilted in the opposite direction, it commands movement in the opposite direction, intermediate positions allowing pivoting of the player toward the right and toward the left.

The table comprises an upper tabletop 4 and a lower tabletop 6, these tabletops being strictly parallel, the tabletop 4 having an upper surface 7 consisting, for example, of a non-tearing mat on which the players and a ball 11 can move, a framework 8 having to withstand thermal and mechanical stresses, and insulator 9 and a conductive surface 10 formed from strips of metallized carbon or a conductive copper mesh, for example.

The lower tabletop 6 is formed from a framework 12 on which rest an insulator 13 and a conductive surface 14 of the same type as the surface 10.

Each player stands on a base 16 adapted to slide freely over the upper surface 7, a permanent magnet 17 fixed under the lower surface of the base being mounted in such a way as to be slightly separated from the upper surface 7.

Carriages 20 between the two tabletops 4 and 6 each correspond to a player.

Each carriage 20 comprises a lower compartment 21 and an upper compartment 22.

Compartment 21 houses two direct current motors 22 and 23, the output shaft 24 of the motor 22 driving, via a reduction gear system 25, a wheel 26 running on the tabletop 6. The output shaft 29 of the motor 23 drives, via a reduction gear system 27, a wheel 28.

Figure 4:
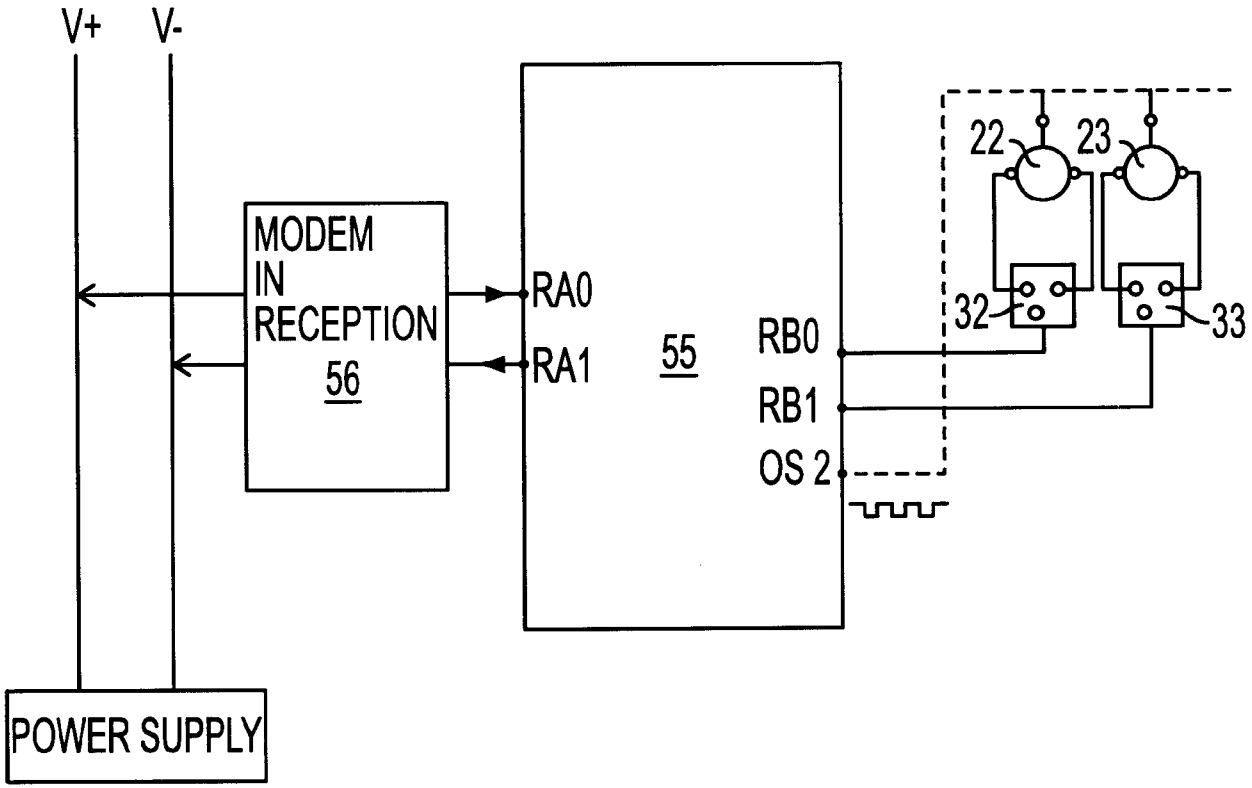
FIG. 4 is a block diagram showing the receiving system.

FIG. 4 is a block diagram showing the control system for the motors 22 and 23.

Figure 6:
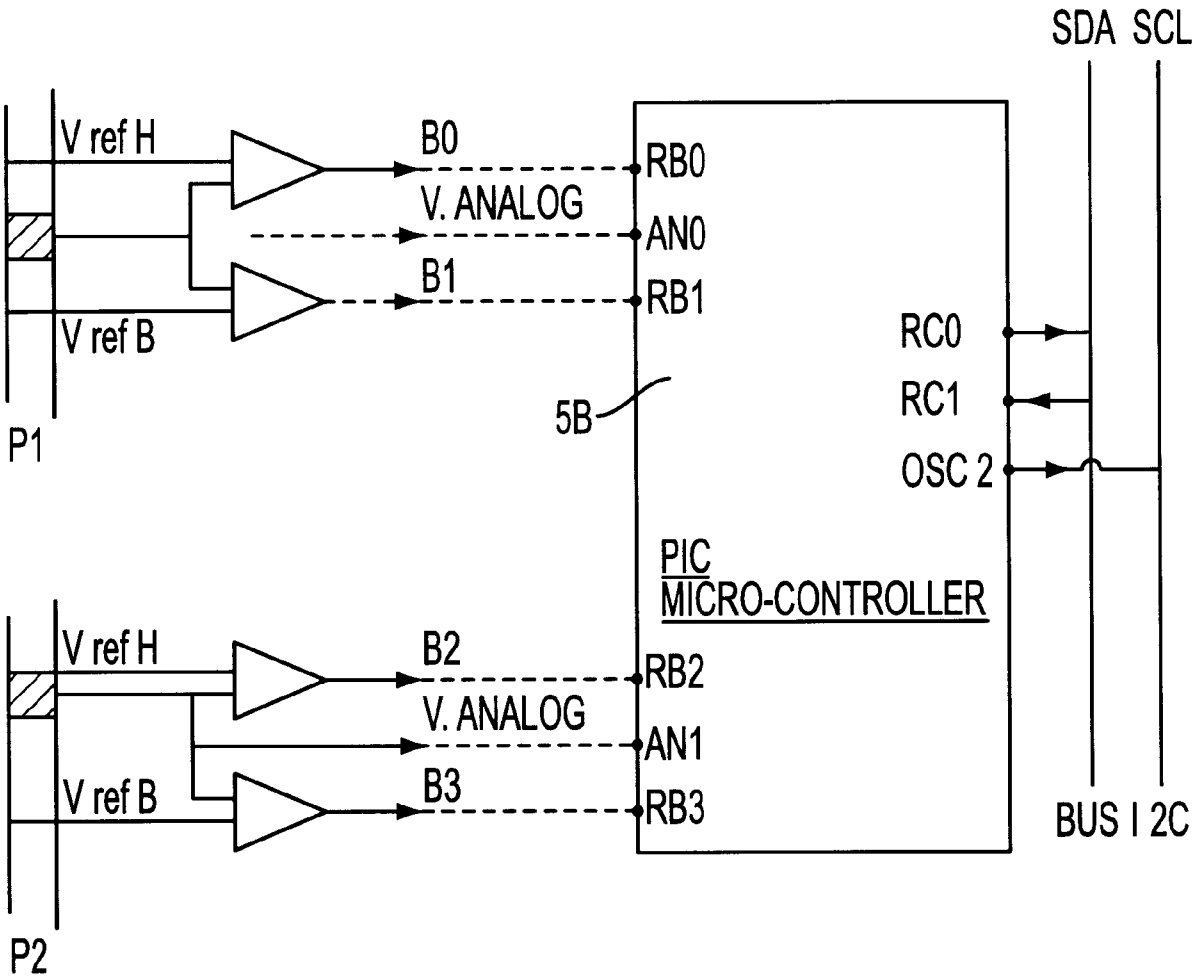
FIG. 6 shows the control system based on control levers.

The control devices comprise two potentiometers whose levers drive sliders (see FIG. 6).

The voltages present at the analog port, during the excursion of the lever, define three zones, namely an intermediate rest zone between a forward movement zone and a reverse movement zone.

Three zones are also defined by the second potentiometer, namely a rest zone between a zone of pivoting toward the right and a zone pivoting toward the left.

The generation of these voltages is simulated by the use of two comparators. The analog voltage is compared simultaneously with a high reference voltage, VrefH and with a low reference voltage VrefB.

The output values of these comparators are the bits which determine the direction of rotation of the motors. The position of the contacts of two relays 32 and 33 define this direction of rotation.

These relays control the switching on of the direct current motors 22 and 23 housed in the compartment 21.

The lever 3 is connected to a transmitting PIC micro-controller 58. The parallel inputs receive the four motor rotation bits; two inputs of the analog-digital converter in the micro-controller receive the two analog signals from the two potentiometers.

The carriage 20 is supported by balls 35 which co-operate with the lower surface of the tabletop 4 and balls 36 which bear against the upper surface of the tabletop 6 in such a way that the carriage can move freely in all directions. The balls 35 and 36 are made of an insulating plastics material.

The compartment 22 supports a permanent magnet 38 which is maintained slightly separated from the lower surface of the tabletop 4.

The compartment 22 contains stacked electronic cards 40 interconnected by connecting bars 41. These cards are powered by a stabilized power supply.

The conductive surface 10 of the upper tabletop 4 is powered by a 12 V stabilized power supply, the carriage 20 supporting sliding contacts 33 which co-operate with the conductive surface, and the voltage at the conductive surface 14 is 0 V, the sliding contacts 44 picking up the power supply current which feeds all of the cards 40 through corresponding conductors, the current returning via the conductive surface 14 and sliding contacts 45.

Figure 5:
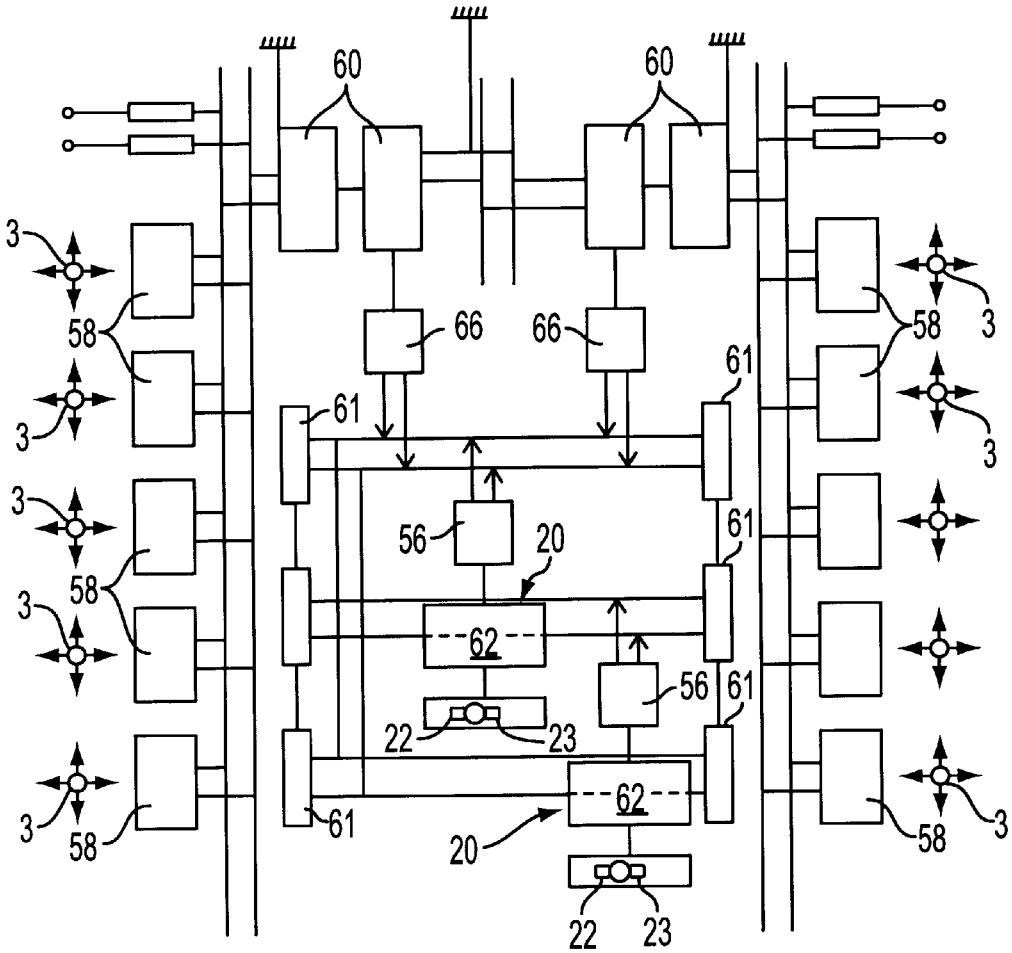
FIG. 5 is a general block diagram.

FIG. 5 shows a general block diagram of the system.

Each control lever 2 is housed in a casing 50 which contains the transmission electronics. The control can be proportional or discrete.

As can be seen in the diagram in FIG. 5, each lever 3 is associated with a transmitting micro-controller 58 preferably connected to a Philips BUS I 2C line or to any other PC-compatible computer network, network control micro-controllers 60 transmitting commands to modems 66 of the carriages 20 which comprise receiving micro-controllers 62, these systems being powered by power supplies 61.

Each transmitting micro-controller 58 sends commands depending on the position of the lever 3 to the carriage 20 which contains the receiver. Parallel ports of RISC architecture PIC micro-controllers 55 (see FIG. 4) constitute a small local network which the network control micro-controllers 60 uses to communicate with the PIC micro-controllers transmitting command messages related to the position of the levers 3 and to transmit these commands to a modem 56.

The voltage at the output of a converter is coded in four bits.

The transmitting PIC will establish contact with a network controller which tells it the receiver it wishes to reach and sends it the commands it wishes to send to this receiver.

A Philips BUS I 2C line or any other PC-compatible computer network (see FIG. 5) enables bidirectional dialog on only two wires. It is a serial mode BUS. As the transmitting micro-controllers 58 do not have a serial interface, one input line and one parallel output line provide this function, using the timer as a transmission clock. Speeds of 9 600 bauds can be achieved in this way. The messages are sent with redundancy or repetition and error checking. This precaution is necessary considering the choice of power supply mode for the receivers, the high probability of interference related to the system of sliding contacts collecting the power supply current, and the rotation of the small motors.

It is thus possible to connect different elements to the BUS: all that is required is to connect each parallel output to two wires.

A protocol is used which assures efficient sharing of the communication facility.

An EEPROM is used to program the data and its processing.

The power supply voltage must be the same for all of the components. The outputs are open-collector outputs (or open-drain outputs in the case of CMOS circuits), and the resultant level on the line is therefore the result of applying an AND function of all of the connected outputs.

Because of the VCC supply pull-up resistors, the SDA signals (data and address signal) and the SCL signals (clock signals) and at 1 is all the outputs are at 1.

These signals are read continuously without risk of interfering with the line level.

After accepting the transmission request from a transmitting micro-controller 58, the network controller 60 searches its memory for the address of the sought receiver, associates it with the motor rotation and speed of rotation commands, and stores everything.

For 100% of the time, it stores such information sent by the elements of the system it controls.

For 50% of the time, it sends the stored information to the receivers via a modulating modem 56. The rate of this serial transmission is faster than that of serial transmissions by the system. The digital data is carried by the power supply over the entire surface of the table. In order to optimize the path of the current, the power supply is over-rated.

The modulation used is either ASK (amplitude modulation if the NE5050 is chosen or FSK (frequency modulation).

FIG. 6 is a diagram showing the connection between the levers 3 and the transmitting micro-controllers 58.

The carriage 20 is preferably made of aluminum and comprises, on its side surface, a layer of elastic foam 65 to damp impacts between carriages.

At the receiving end, the modem 56, in its receiving mode, demodulates the received signal. As computer data is sensitive, since on piece of interference is all that is necessary to falsify the message, the modem is capable of eliminating noise and interference from the power supply. The digital message is then analyzed by the associated PIC micro-controller. The address received is compared with the receiver's own address, which is unique. The message is received several times and is subjected to error checking.

If all of these checks are correct, the micro-controller 55 processes the commands, allocating them either to power outputs controlling relays or to the generation of a square-wave signal, simulating PWM control.

In general terms, there are two independent systems of transmitters, one for each team, each having their network controller and a transmitting modem.

A dedicated bidirectional line can be provided between the two controllers alternatively carrying stop transmission commands for 50% of the time.

Communication is therefor shared equally between the two teams. Management of communication is independent within each team.

A card 40 carries Darlington bridges, or any other variable speed drive, which control the speed of the motors 22 and 23. This card also carries relays controlling the switching on of the motors.

In this way, a lever 3 controls the movement of a player 2 in all directions, that is to say slow or fast forward movement, slow or fast reverse movement and pivoting to the right or to the left. The base 16 is preferably octagonal to allow better control of the ball 11 and the fast forward control simulates kicking the ball.

The invention is not limited to the embodiment which has just been described and shown, of course. Numerous modifications can be applied to it without departing from the scope of the invention.

There is claimed:

1. A game, of the table soccer type, comprising a playing surface, pieces imitating players, a ball simulating a football and, along the table, on each of two opposite sides, a series of control levers, wherein each lever corresponds to the movement of a player, each player is connected to a carriage comprising two motors, each of which drives a wheel, and an electronic receiving unit, and each control lever is attached to a transmitter unit in order to control selectively the power supply to one or the other of said motors in one direction or the other.

2. The game claimed in claim 1, where said table comprises two parallel tabletops, namely an upper tabletop and a lower tabletop, between which said carriages are suitably guided and comprising, on each of their upper parts, a permanent magnet, and each player has a base in which a corresponding permanent magnet is inserted.

3. The game claimed in claim 1, wherein said magnets in said carriage and in the player's base are fixed so that a slight gap is formed between the two faces of the corresponding upper tabletop.

4. The game claimed in claim 2, wherein said upper tabletop has an upper surface consisting of a mat, a framework, an insulator and a conductive surface.

5. The game claimed in claim 2, wherein said lower tabletop has a conductive upper surface, an insulator and a framework.

6. The game claimed in claim 1, wherein each carriage comprises insulating balls co-operating with the lower face of said upper tabletop and insulating balls co-operating with the upper face of said lower tabletop.

7. The game claimed in claim 1, wherein each carriage comprises sliding contacts co-operating with said conductive surface of said upper tabletop and sliding contacts co-operating with said conductive surface of said lower tabletop.

8. The game claimed in claim 1, wherein each lever is connected to a transmitting micro-controller enabling a network controller micro-controller to communicate to said transmitting micro-controllers messages relating to the position of the handles in order to transmit these commands to a modem which, using the carrier current technique, associates the messages with the power supply of the receiving modules of the carriages, comprising a demodulating modem upstream of a message-receiving micro-controller and in which are installed motors associated with Darlington bridges.

9. The game claimed in claim 8, wherein said levers control two potentiometers whose voltages at said analog port define, for one of them, three zones, namely an intermediate rest zone between a forward movement zone and a reverse movement zone, whilst the other one defines three zones, namely an intermediate rest zone between a zone of pivoting toward the right and a zone of pivoting toward the left, the generation of these voltages being simulated by two comparators which compare the analog voltage with a high reference voltage and with a low reference voltage, the output value of these comparators being bits which determine the direction of rotation of said motors.

* * * * *